US008640931B2

(12) United States Patent
O'Keefe, Jr. et al.

(10) Patent No.: US 8,640,931 B2
(45) Date of Patent: Feb. 4, 2014

(54) TRI-FUNCTION TAP FOR BEVERAGES

(75) Inventors: Edward L. O'Keefe, Jr., Traverse City, MI (US); Robert G. Kalik, Bethesda, MD (US); Karl Fritze, Hastings, MN (US)

(73) Assignee: Emerald Wine Systems, LLC, Traverse City, MI (US)

( * ) Notice: Subject to any disclaimer, the term of this patent is extended or adjusted under 35 U.S.C. 154(b) by 0 days.

(21) Appl. No.: 13/364,070

(22) Filed: Feb. 1, 2012

(65) Prior Publication Data

US 2012/0199615 A1 Aug. 9, 2012

Related U.S. Application Data

(60) Provisional application No. 61/438,503, filed on Feb. 1, 2011, provisional application No. 61/438,500, filed on Feb. 1, 2011.

(51) Int. Cl.

| | |
|---|---|
| ***B67D 3/00*** | (2006.01) |
| ***B67D 7/06*** | (2010.01) |
| ***B65D 5/72*** | (2006.01) |
| ***B65D 25/40*** | (2006.01) |
| ***B65D 35/38*** | (2006.01) |
| ***B22D 37/00*** | (2006.01) |
| ***B22D 41/00*** | (2006.01) |
| ***C21B 7/12*** | (2006.01) |

(52) U.S. Cl.

USPC ..... 222/505; 222/501; 222/509

(58) Field of Classification Search

USPC ..... 222/505, 326, 501, 509, 518, 515; 251/84, 85, 86, 265, 215; 141/2, 113

See application file for complete search history.

(56) References Cited

U.S. PATENT DOCUMENTS

| | | | | |
|---|---|---|---|---|
| 2,177,278 | A * | 10/1939 | Hill et al. | 251/149.6 |
| 4,982,881 | A * | 1/1991 | Amrein | 222/514 |
| 6,321,948 | B1 * | 11/2001 | Bellon et al. | 222/153.14 |
| 6,758,457 | B2 * | 7/2004 | Nicolino et al. | 251/149.6 |
| 7,387,140 | B2 * | 6/2008 | Brunn | 141/383 |
| 7,503,592 | B2 * | 3/2009 | Durieux et al. | 285/316 |
| 7,681,764 | B2 * | 3/2010 | Nini | 222/519 |
| 7,721,755 | B2 * | 5/2010 | Smith et al. | 137/384 |
| 8,006,874 | B2 * | 8/2011 | Smith et al. | 222/505 |
| 2004/0056054 | A1 * | 3/2004 | Ottolangui | 222/544 |
| 2008/0245816 | A1 * | 10/2008 | Armstrong et al. | 222/81 |
| 2008/0314930 | A1 * | 12/2008 | Green | 222/185.1 |
| 2011/0011897 | A1 * | 1/2011 | Bellmore et al. | 222/505 |

* cited by examiner

*Primary Examiner* — Paul R Durand

*Assistant Examiner* — Benjamin R Shaw

(74) *Attorney, Agent, or Firm* — Feldman Gale, P.A.; Gregory L. Hillyer; A. Robert Weaver

(57) ABSTRACT

A tap for liquids dispenses liquids including wines from plastic bags or bladders packaged in cardboard boxes, and has three modes of operation. Liquids may be dispensed from the box on a shelf by manually turning a rotatable cap to open a valve for liquid to flow by gravity; an adapter attached to the tap automates the process and dispenses liquids through a pump; and the tap may be used to fill bags or bladders from an automated filling machine. In a first embodiment, the rotatable cap must be manually opened for both manual and automated operation. In a second embodiment, the rotatable cap may remain closed and the adapter can still dispense liquids through the tap using a pump.

14 Claims, 16 Drawing Sheets

TRI-FUNCTION TAP FOR BEVERAGES

CROSS REFERENCE TO RELATED APPLICATIONS

This application claims the benefit of U.S. Provisional Patent Application No. 61/438,500, filed Feb. 1, 2011, and U.S. Provisional Patent Application No. 61/438,503, filed Feb. 1, 2011, the disclosures of which are hereby incorporated herein by reference in their entireties.

BACKGROUND

For centuries, wines and other beverages have been offered in glass jugs or bottles, which are filled at the point of manufacture and are transported to the locales where they will be opened and consumed. Because wines, in particular, are subject to deterioration and degradation once they have been exposed to oxygen, the standard method of delivery has been for the ultimate user to purchase wine by the bottle, and to open it only at the time when it will be consumed. Because wine, once opened, will not "keep" for more than a few days before its quality deteriorates, most wine is delivered in 750 ml bottles, and is intended to be consumed within a few hours of first being opened.

Because glass is breakable, glass wine bottles tend to be thick and correspondingly heavy, making long distance transportation both cumbersome and expensive. Nevertheless, because there are truly only a few regions of the world in which high quality wines are made, long distance transportation of wines in glass bottles is a problem for which few alternative solutions have been discovered. One increasingly popular alternative to packaging wine in glass bottles is to package it in plastic bags (or bladders) or foil pouches, and in some instances to package the filled bladders in cardboard or corrugated boxes for shipping and dispensing. Since plastic bladders can be used that, when treated with an $O_2$ inhibitor, are essentially impermeable to oxygen, and because the bladder is flexible enough to reduce in size as wine is dispensed, the wine can be kept free from oxygen throughout the dispensing process, and can last for a period of months prior to being dispensed. As a result, wine-in-a-box or pouches has become popular with bars, taverns, and restaurants, who can now keep a variety of fine wines available for customers without having to waste wine in bottles that did not get used before quality deteriorates. In larger commercial establishments, wine "cabinets" or "bars" holding a number of different kinds of wine can be used with pumps and dispensing equipment to dispense wines as necessary, much in the same way that beer has been dispensed from casks or kegs for centuries. For smaller establishments and residential use, wine-in-a-box can be dispensed from a shelf using only gravity to cause the wine to flow.

Other beverages may also enjoy similar benefits from being placed in plastic bags that can then be packaged for shipment and dispensing in cardboard or corrugated boxes. However, the extreme sensitivity of wine to oxygen and to heat, and the relatively high expense of wine as compared to other beverages has caused wine to be the product that has driven innovation in this field.

One drawback to the mass production of wine packaged in boxes is that the various establishments and users have different taps or spigots (or none at all) for the dispensing of wine into glasses for consumption. What is needed is a tap that can be used for the filling and sealing of a plastic bladder, and that can also be used manually, to dispense wine from a shelf using gravity, or that can alternatively be attached to a pump and other auxiliary equipment for automated dispensing.

SUMMARY OF THE INVENTION

The invention refers to a tap for dispensing liquids from a container or injecting liquids into a container. In a first embodiment, the invention comprises a valve cap with fluted hand knob, a tap body and a sealing means. The tap body serves as the intermediary that allows liquids to transfer out of an attached container (e.g., bags or containers of the "bag-in-box" variety). In a second embodiment, the invention comprises a valve cap with fluted hand knob, a tap body, sealing means, and a biasing spring. Both embodiments include additional embodiments comprising an adapter for connection to a dispensing pump.

The invention comprises a tap that provides two means for dispensing a liquid, and a third means which may be used for filling the container. The tap of this invention can dispense liquids when connected to a pumping system (e.g., in a wine-dispensing system), and it can dispense liquids using gravity flow "off the shelf" when the valve cap's fluted hand knob is manually turned in a counter-clockwise direction (e.g., on bag-in-box packaging used to contain wine).

The invention also may be used in conjunction with a pumping system as a conduit for injecting liquids into a container in order to fill the container. This may be accomplished by connecting a quick-coupling adapter to the tap's dispensing outlet or by using a filling machine having an interface that receives a spout of the tap of the invention. Alternatively, tubing may be used to deliver wine via a pumping system, such as a peristaltic pump, from the box through the tap and into a drinking glass.

The invention integrates a dual method of dispensing as well as combining a single tap for dispensing and filling. The invention is further distinguished from other liquid-dispensing taps because, in an embodiment, it can be constructed with an attached gland. In either embodiment—with or without an attached gland—the invention inhibits oxygen from coming into contact with the liquids within the container, When the invention does not include an attached gland, the invention is inserted into the gland portion of a bag, creating a dual-layer oxygen barrier composed of the gland and tap materials. When the invention is constructed with an attached gland, the gland portion of the tap can be positioned in a bag in such a manner that the ethylene vinyl alcohol (EVOH) treated bag material overlaps the gland, which is heat sealed to the bag, providing a permanent bond. This bond creates an air-tight seal between the invention and the bag.

The invention is composed of a minimum number of parts in order to reduce cost. In addition, the invention improves upon other liquid-dispensing taps, which only can be utilized in a pumping system with the addition of an adaptor part. The invention requires no separate adaptor to be integrated into a pumping system, but can attach to a pumping system using only the adaptor that is integral to the pumping system.

The invention is relevant to the beverage and food service industries, and may also be used effectively in the medical and pharmaceutical industries, and other industries utilizing similar pump and fill packaging.

DETAILED DESCRIPTION OF THE PREFERRED EMBODIMENTS

Figure 1:
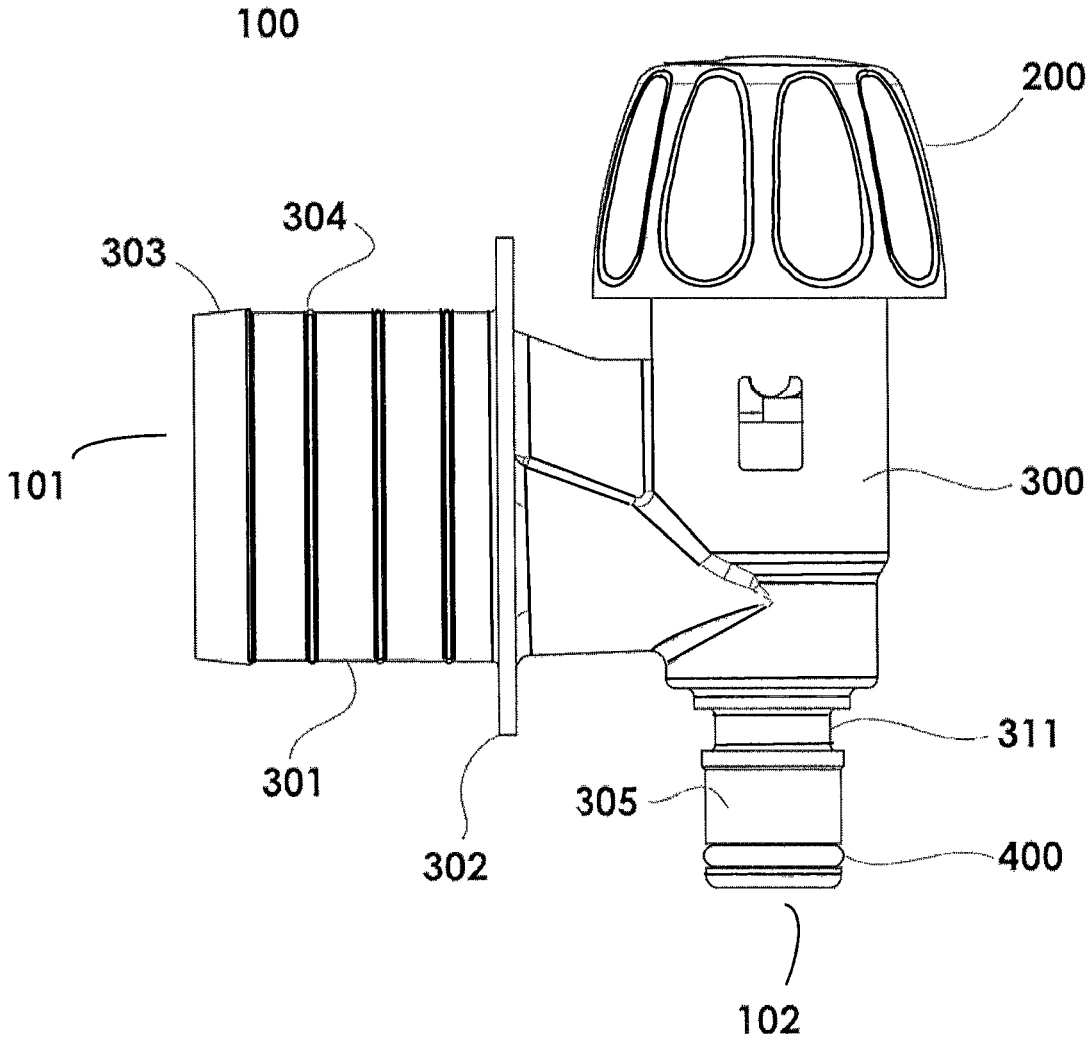
FIG. 1 is a side view of the invention showing the embodiment using manual flow control.

As illustrated in FIG. 1, an external side view of an exemplar embodiment of the trifunction dispensing tap 100 comprises valve cap 200, a tap body 300, and a sealing means 400. Tap body 300 serves to be the intermediary which allows fluids to transfer from a bag-in-box reservoir 101 to the dispensing container or dispensing conduit 102. The tap body is preferably integrally molded from a thermoplastic resin such as polyethylene or polypropylene, but can be molded from numerous materials such as rigid polyurethane, acetal, polyphenylene oxide, polyester, polyamide, polyphenylene sulphide, polyethylene terephthalate, ABS, polycarbonate, and polysulphone. Numerous criteria are considered when choosing a polymer such as cost, ease of molding, oxygen permeability, flexibility, strength, chemical resistance, and operational temperature. Polyolefins such as polypropylene and polyethylene are commonly used for similar types of single-method dispensing taps. It is of particular interest that a resin be chosen for its structural behavior near or below freezing temperatures. Polypropylene becomes very brittle at these temperatures and can shatter like glass if stressed while at or below freezing temperatures, but has good strength and rigidity at above freezing temperatures, which is desirable. High density polyolefins can approach the stiffness of polypropylene but will not become brittle when subjected to freezing conditions, therefore HDPE is presently preferred. Valve cap 200 is preferably integrally molded from a thermoplastic resin similar to tap body 100. However, it is desirable to choose a lower density polyethylene, such as LDPE so as to from a variety of low durometer elastomeric materials such as Butyl, Buna-N, EPDM, Nitrile, Silicone, Neoprene, or Viton. A primary consideration is given to the material's low-cost performance given the particular fluid's chemical characteristics. Given these considerations, 70-80 durometer EPDM is a practical choice for fluids such as wine. Tap body 300 comprises inlet end geometry 301 to sealingly adapt to gland fitment which is welded to and part of the bag-in-box reservoir. The gland is typically made from HPDE and has a hollow bore such that tap body lead-in feature 306 (shown in FIGS. 6 and 8) can press into and deform the gland bore slightly as the tap body is inserted up to the depth of the limit flange 302. As tap body 100 is inserted, the at least one sealing rib 304 makes a liquid-tight seal from the tap body 100 to the gland bore. Tap body 100 has a dispensing outlet 305 which serves to direct fluid exiting the tap and allows a connection means to a suitable receivably engaging adapter 500 (shown in FIG. 4). Dispensing outlet 305 has a groove to accept sealing means 400, which may be a rubber or plastic gasket or any other suitable O-ring known in the art, and provides for a retention feature 311 to secure the adapter 500.

Figure 2:
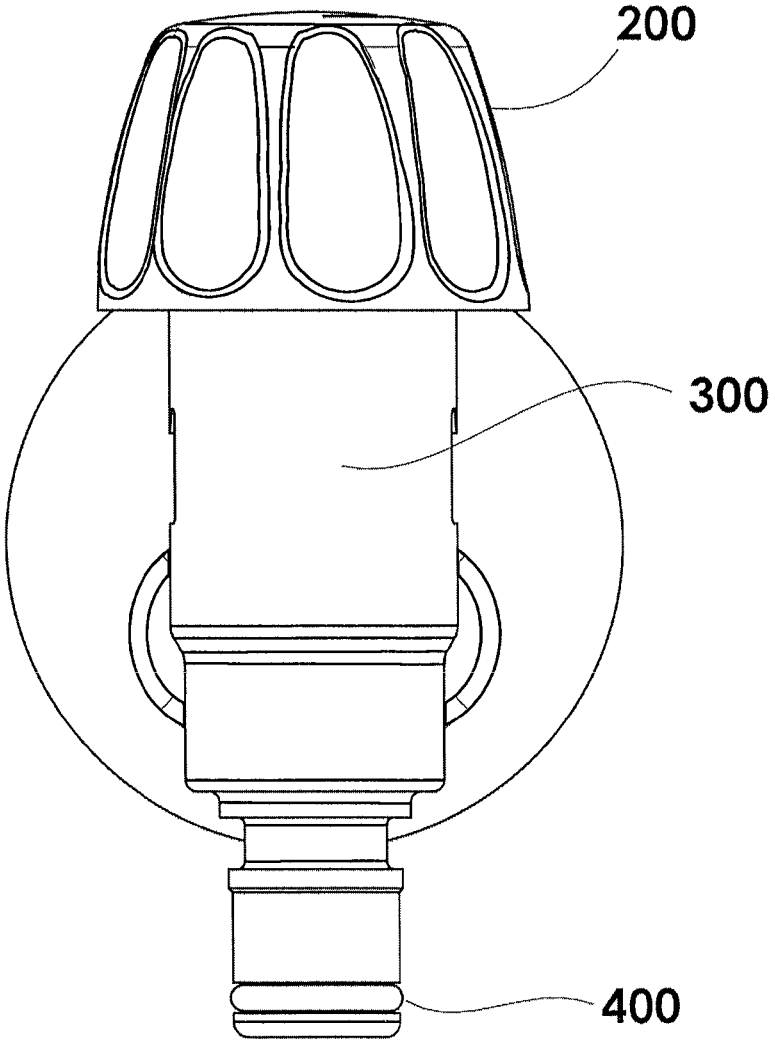
FIG. 2 is a front view of the embodiment shown in FIG. 1.

FIG. 2 illustrates exemplar embodiment of tri-function dispensing tap 100 as seen from the front, its three components shown assembled. Sealing means 400 can be integrally molded into tap body 300 in the form of sealing ribs or even over-molded with an elastomeric material making the tap body 100 integral with its external sealing means 400.

Figure 3:
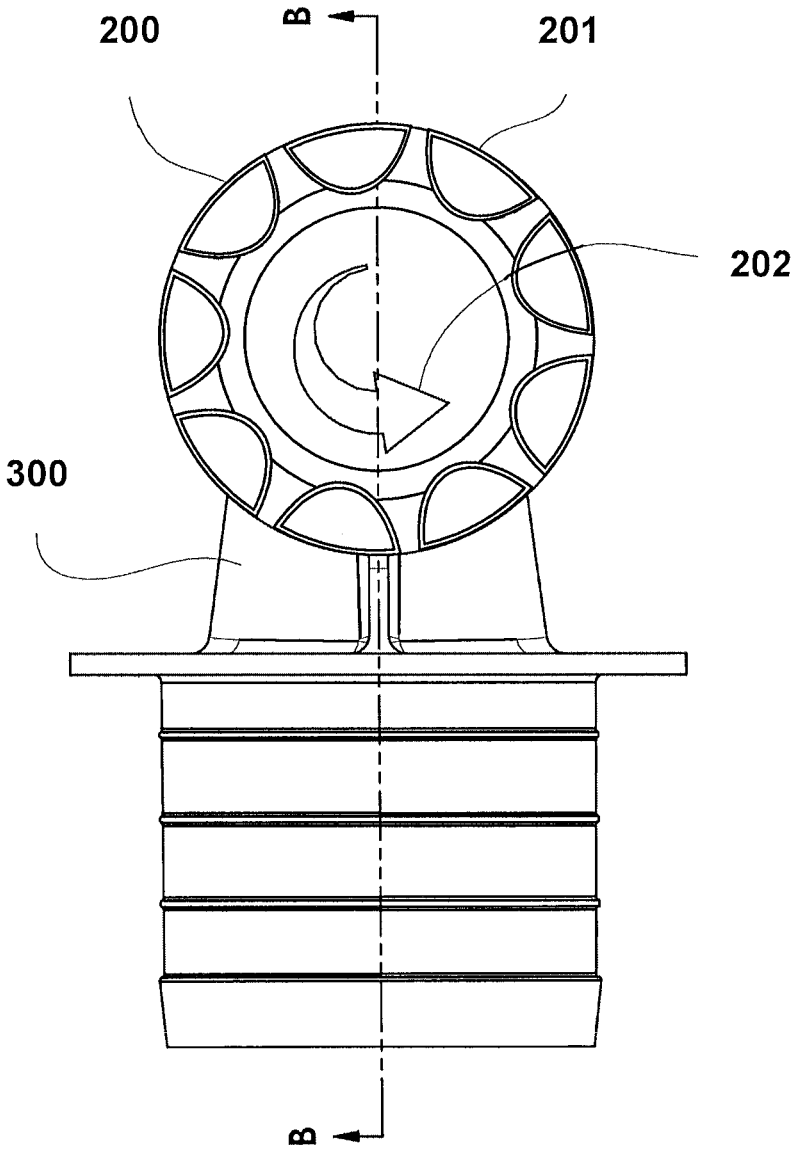
FIG. 3 is a top view of the embodiment shown in FIG. 1.

FIG. 3 illustrates the tri-method dispensing tap 100 as seen from the top. The valve cap 200 is shown with a fluted hand knob whose large diameter and, in the embodiment depicted in FIG. 3, deep depressions 201 provide substantial hand gripping contact forces to twist the knob clockwise to close, and anti-clockwise to open. The direction of rotation of valve cap 200 to open the valve is a matter of design choice, and may be either direction. Directional indicator 202 is molded into the valve cap 200 knob such that the direction and flow amount are symbolized in an increasing width curved arrow. As the arrow is curving anti-clockwise and growing larger, the corresponding flow rate becomes greater. The view from section line B-B is shown in FIG. 6.

Figure 4:
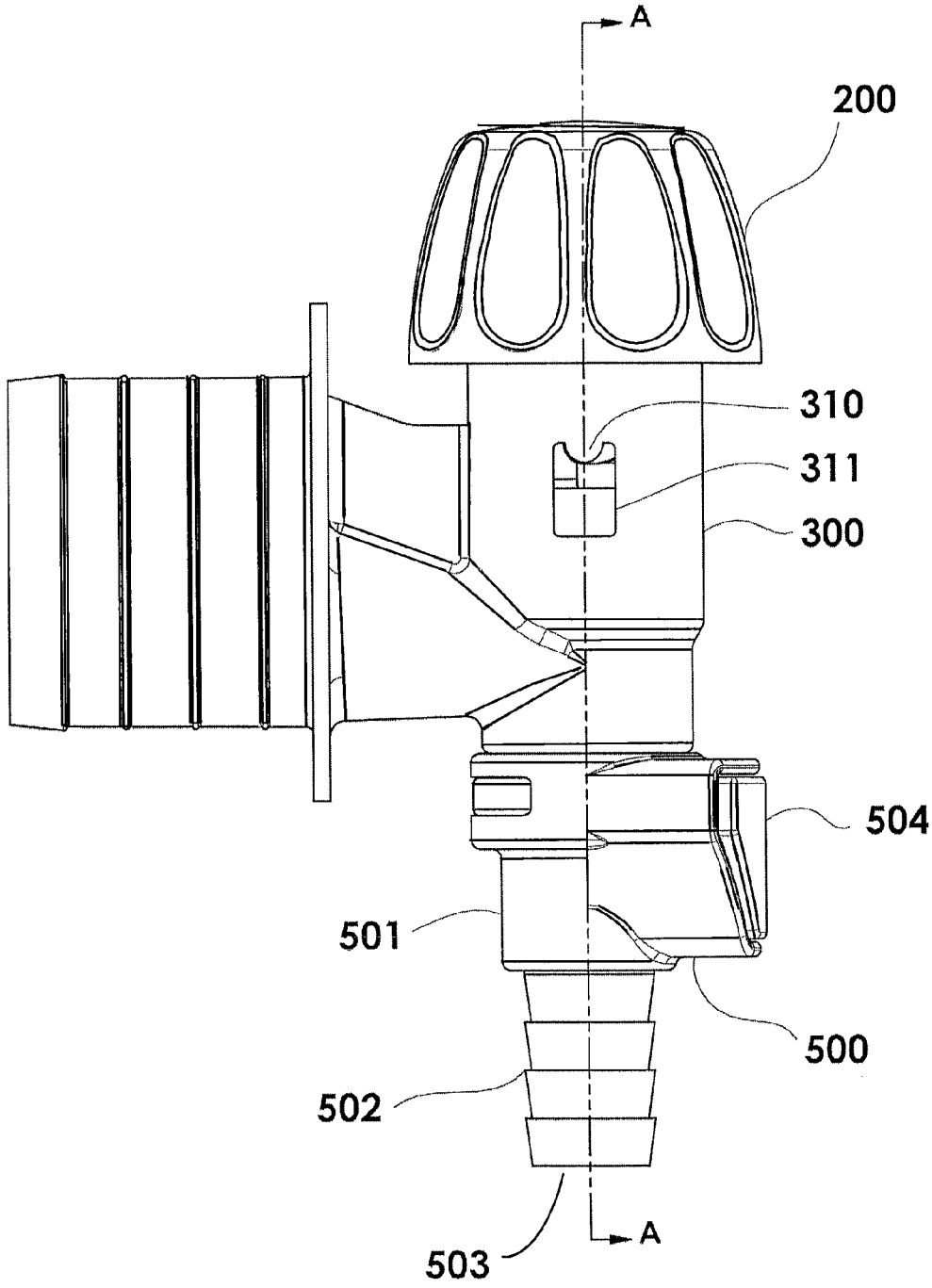
FIG. 4 is a side view of an alternative embodiment showing the tap configured to deliver liquids to a pumping system.

FIG. 4 illustrates an embodiment of the tri-method dispensing tap 100 as seen from the side with receivably engaging adapter 500 attached. Adapter 500 depicts a generic variety of connector with a female socket 507 (shown in FIG. 5) and a male hose barb 502. Adapter body 501 provides features for lockingly engaging tap body dispensing outlet 305 by actuating quick-release button 504. Sealing means 400 provides for a radial compression seal with adapter socket 507 as shown on FIGS. 5 and 6. Tap body 300 is provided with at least one rotational engaging means 310 such as a helical thread, bayonet tab, cam boss, or the like. Tap body window 311 is useful in injection molding to provide for a moldable feature such as the cam boss depicted for rotational engaging means 310. The view from section line A-A is shown in FIG. 5.

Figure 5:
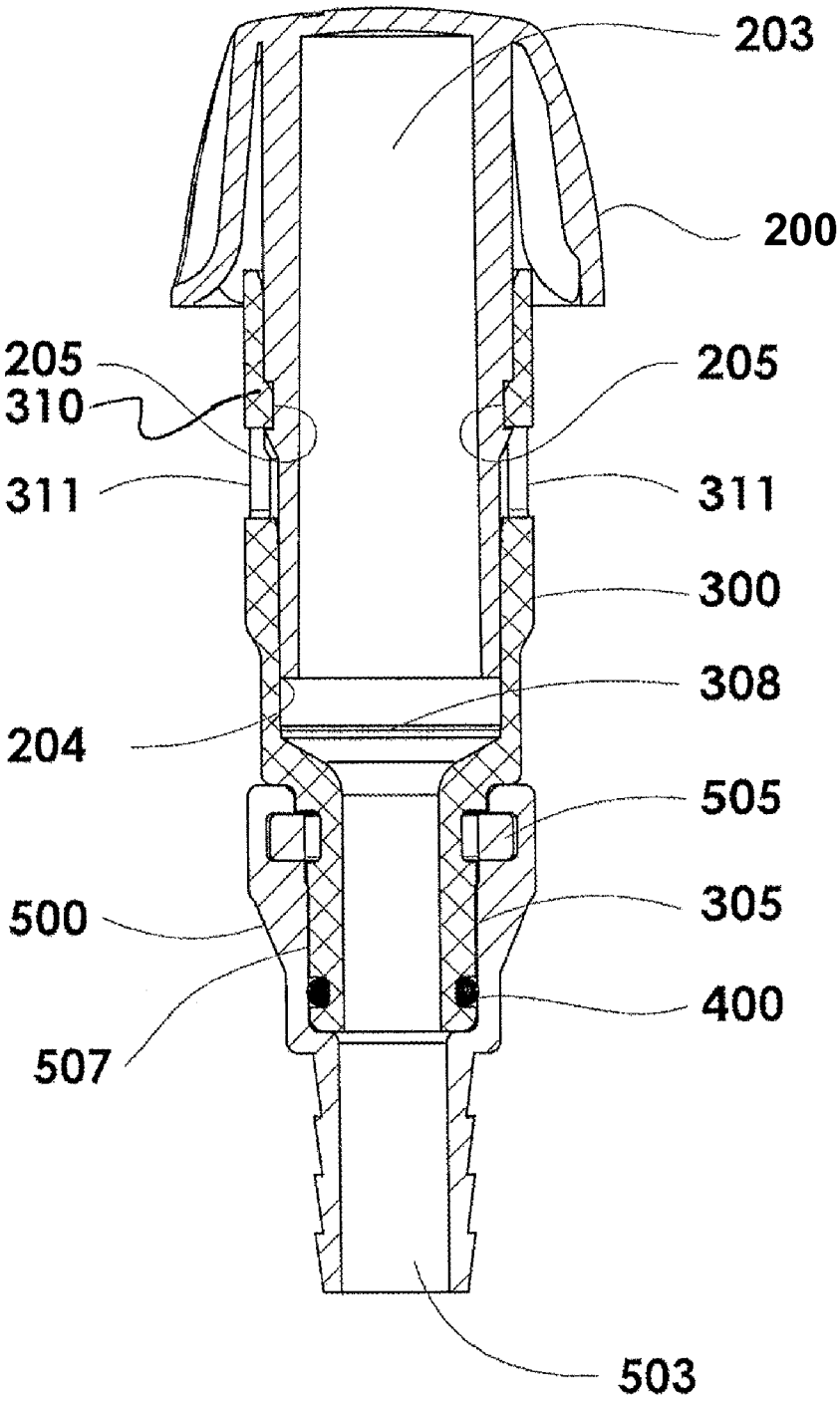
FIG. 5 is a front sectional view taken along line A-A of FIG. 4.

FIG. 5 illustrates the tri-function dispensing tap in cross-section A-A, taken from FIG. 4. Adapter 500 is shown as attached and locked in place with sealing means 400 shown as compressed in a radial fashion between adapter socket 507 and dispensing outlet 305. Adapter 500 has exit port 503 for providing a leakproof outlet for fluid flow. Typically, adapter 500 is attached to a flexible tube via the male hose barb 502. Additionally, FIG. 5 shows the valve cap rotational engaging means 205 in communication with tap body rotational engaging means 310. The at least one valve cap rotational engaging means 205 is depicted herein as a cam track which provides for a helical path imparting vertical or axial motion when valve cap 200 is undergoing rotation. When the valve cap rotational engaging means 205 are rotated anti-clockwise against the static cam boss 310, the valve cap ascends outward and upward. Any features such as a helical thread, bayonet tab, cam track, boss, or the like are preferably limited to provide the necessary valve lift within 90 to 180 degrees of rotation and preferably no more than 90 degrees to allow quick, easy, and intuitive ¼ turn valve operation. Valve seat 204 rotates and descends into tap body seal 308. Seal 308 is configured to provide for a deforming leak-tight fitment to valve seat 204.

Figure 6:
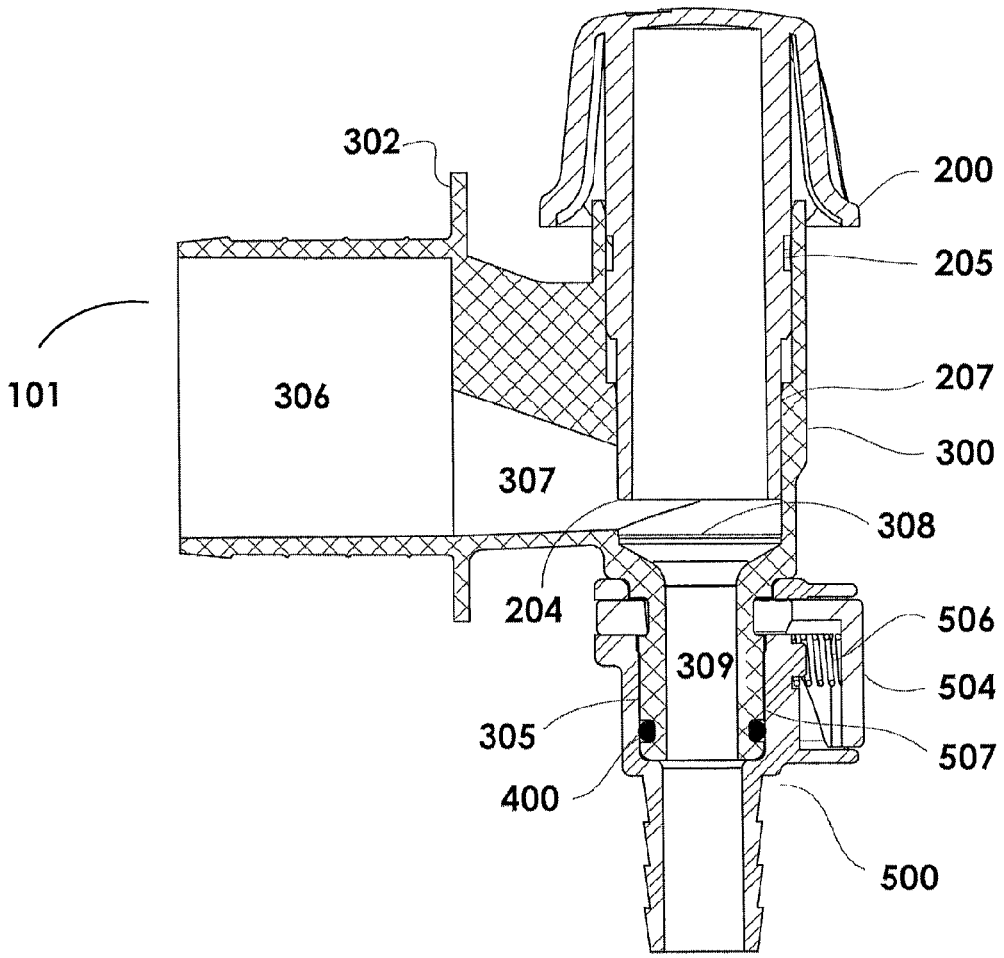
FIG. 6 is a side sectional view taken along line B-B of FIG. 3.

FIG. 6 illustrates the tri-function dispensing tap 100 in a cross-section B-B from FIG. 3. This view shows the fluid path 101 as it comes from the bag-in-box reservoir into tap body inlet 306. Fluid from tap body inlet 306 passes into transition region 307 where the fluid stops until valve seat means 204 lifts off of tap body seal means 308 thereby opening the tri-function dispensing tap valve. Fluid then flows through tap body outlet 309 and into a drinking vessel.

Alternately, tap body outlet 309 allows fluid to flow into adapter 500 as shown, wherein the fluid is then transported via flexible conduit for remote dispensing. Adapter 500 incorporates a spring element 506 which allows for simple push-on engagement and leak-tight connection and which requires an overriding force in latch button 504 to release adapter 500 from tap body retention feature 311.

Figure 7:
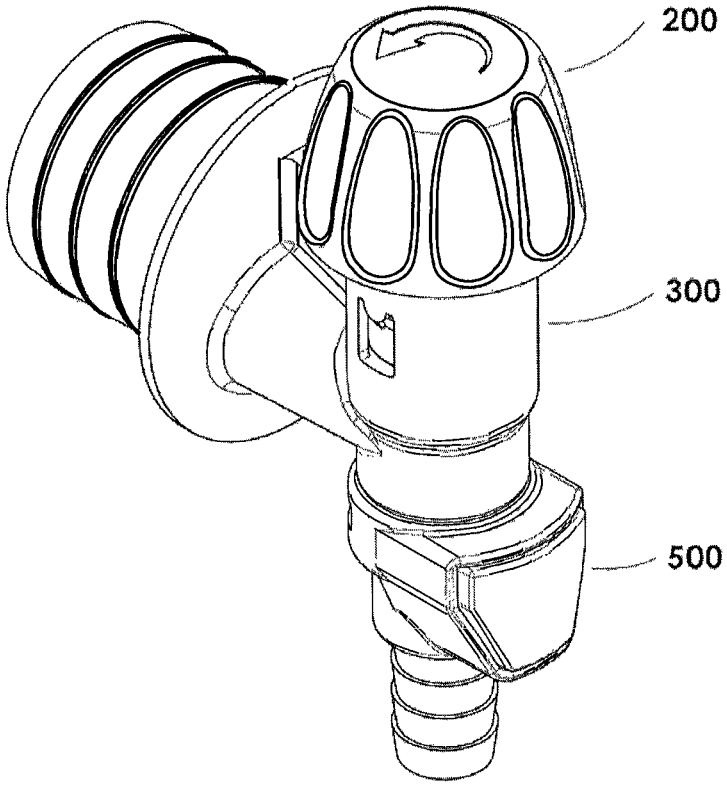
FIG. 7 is a perspective view of the embodiment shown in FIG. 4.

FIG. 7 illustrates the tri-method dispensing tap in an isometric view and depicts overall appearance and integration of the main components valve cap 200, tap body 300, and adapter 500.

Figure 8:
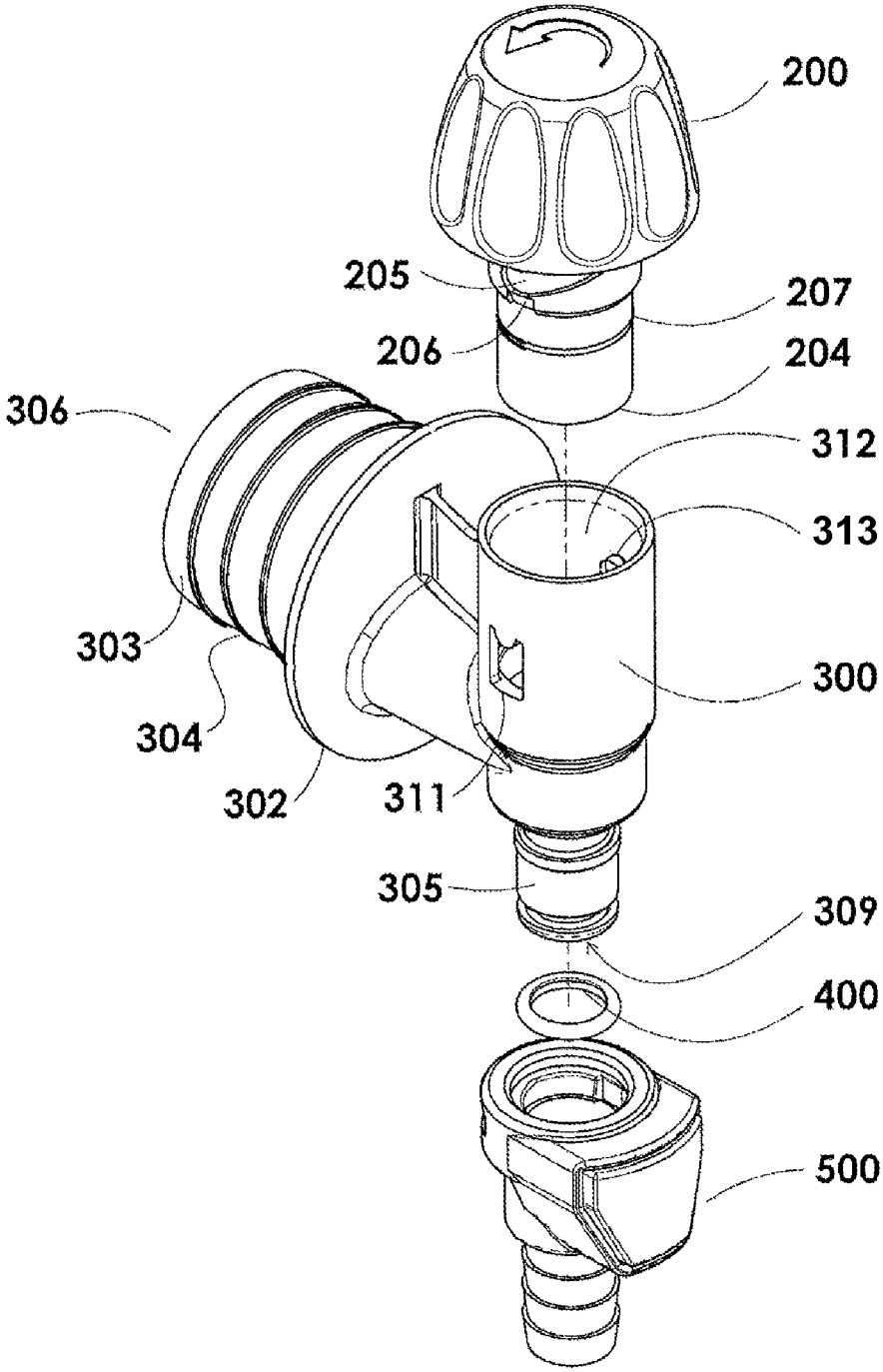
FIG. 8 is an exploded view showing the components of the embodiment shown in FIG. 7.

FIG. 8 illustrates the tri-function dispensing tap 100 in an exploded isometric arrangement and shows greater detail of the internal tap body static cam boss 310 and valve cap rotational engaging means 205. It can be seen that valve cap rotational engaging means 205 has a chamfered notch 206 to allow for initial assembly of the valve cap 200 into the tap body 300. The chamfered notch 206 allows for the valve cap to deform and jump past the tap body cam boss 310 as it is inserted during assembly. Once Cam boss 310 has jumped past notch 206, the cam boss 310 is seated securely and permanently into cam track 205. Cam track 205 can have additional features such as a ramps or a detent to give a tactile feel and locking means to prevent valve cap 200 from gradually rotating open by itself and requires an extra bit of twisting force to initiate the opening of the valve during twisting. Valve cap 200 has integral sealing means 207 which seals the valve cap 200 into the tap body smaller inner bore 312. Stiffing rib 313 adds considerable strength to tri-function dispensing tap 100 particularly when large side loads are placed onto the tap body 300 from undesirable tugging on the tube.

Figure 9:
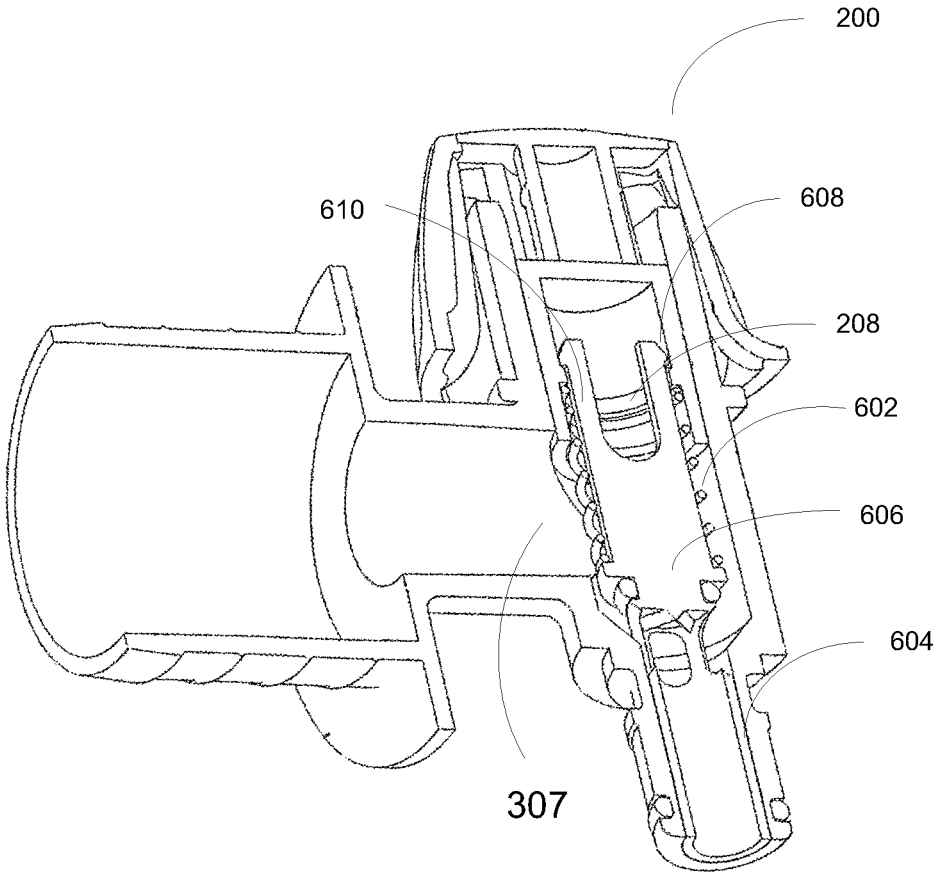
FIG. 9 is a perspective sectional view showing a manually operated embodiment having a biasing spring with the tap in an open position.

FIG. 9 depicts another embodiment of the tap of this invention in which a compression spring 602 is used to press valve 600 (shown in detail in FIG. 10) downward to shut off the flow of liquid when valve cap 200 is in the closed position. In this embodiment, valve 600 has an upper portion 606 that acts as a valve stem and that is raised (opened) or lowered (closed) as valve cap 200 is manually opened or closed, and a lower portion 604 that has passageways through which liquid may flow when the valve is open.

Figure 10:
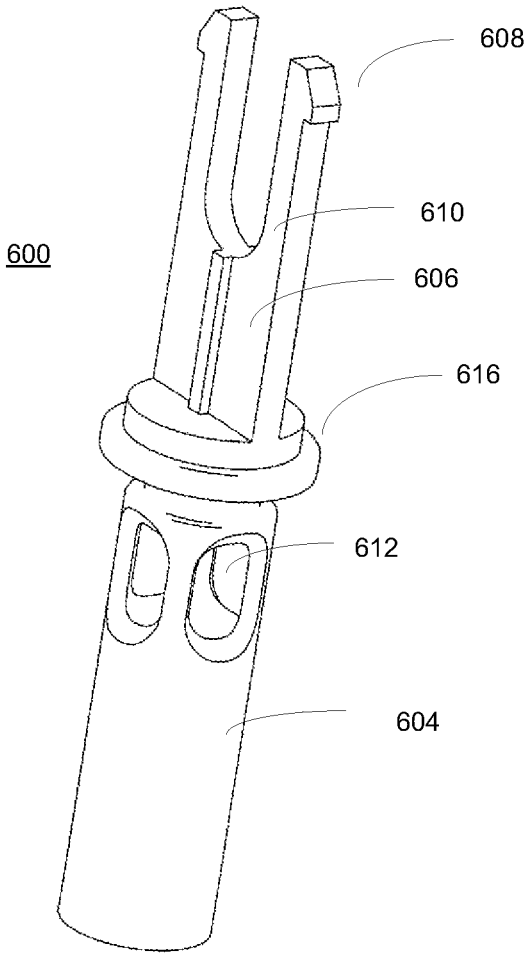
FIG. 10 is a perspective view showing detail of the valve in the embodiment shown in FIG. 9.
Figure 11:
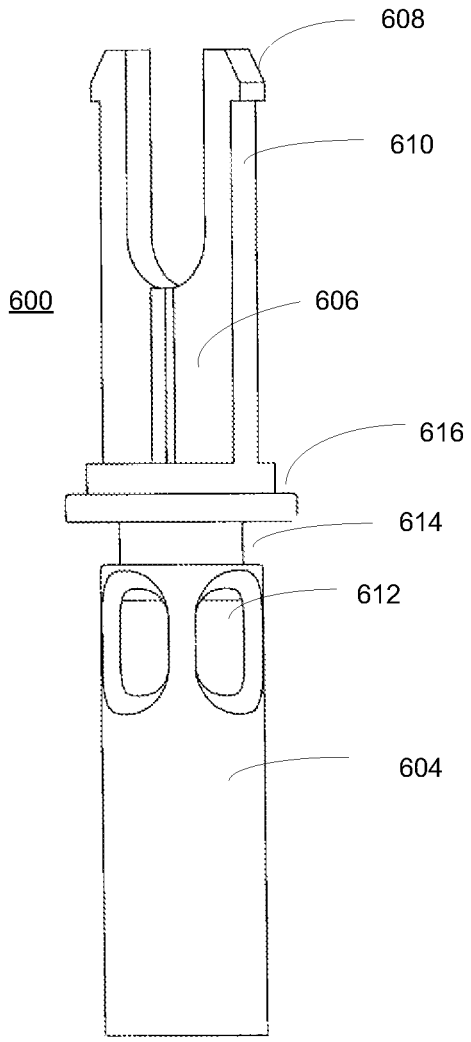
FIG. 11 is a quarter side view showing detail of the valve of FIG. 10.

FIGS. 10 and 11 provide detailed views of valve 600. An upper portion, valve stem 606, comprises two resilient fingers 610, each of which terminates in an outwardly-facing barb 608. The resilient fingers 610 and outwardly-facing barbs 608 permit easy assembly of the tap, in which valve 600 may be inserted from the bottom of the tap through exit port 309 simply by squeezing resilient fingers 610, which will snap back after insertion to hold valve 600 within the tap. Barbs 608 fit through and spring back against internal ridge 208 (shown in FIG. 12) which runs circumferentially around the interior cavity of valve cap 200. Once installed, barbs 608 rest against the upper lip of internal ridge 208 such that, when valve cap 200 is raised to an open position, barbs 608 and resilient fingers 610 are raised to lift the lower portion of valve 604 into the open position.

The lower portion of valve 600 is a hollow cylinder 604 that has four openings, or windows 612, through which wine or other liquid will flow when the valve is in the raised, or open, position. Above windows 612 is a groove 614 to receive an elastomeric seal which may be in the form of an O-ring about valve 600. When the valve is in the lowered, or closed, position, the elastomeric seal will contact the lower, funnel shaped portion of the tap, to create a seal that prevents fluid from flowing through the tap. Above groove 614 is a cylindrical base 616 which supports valve stem 606 and provides a platform to support the lower end of compression spring 602.

Figure 12:
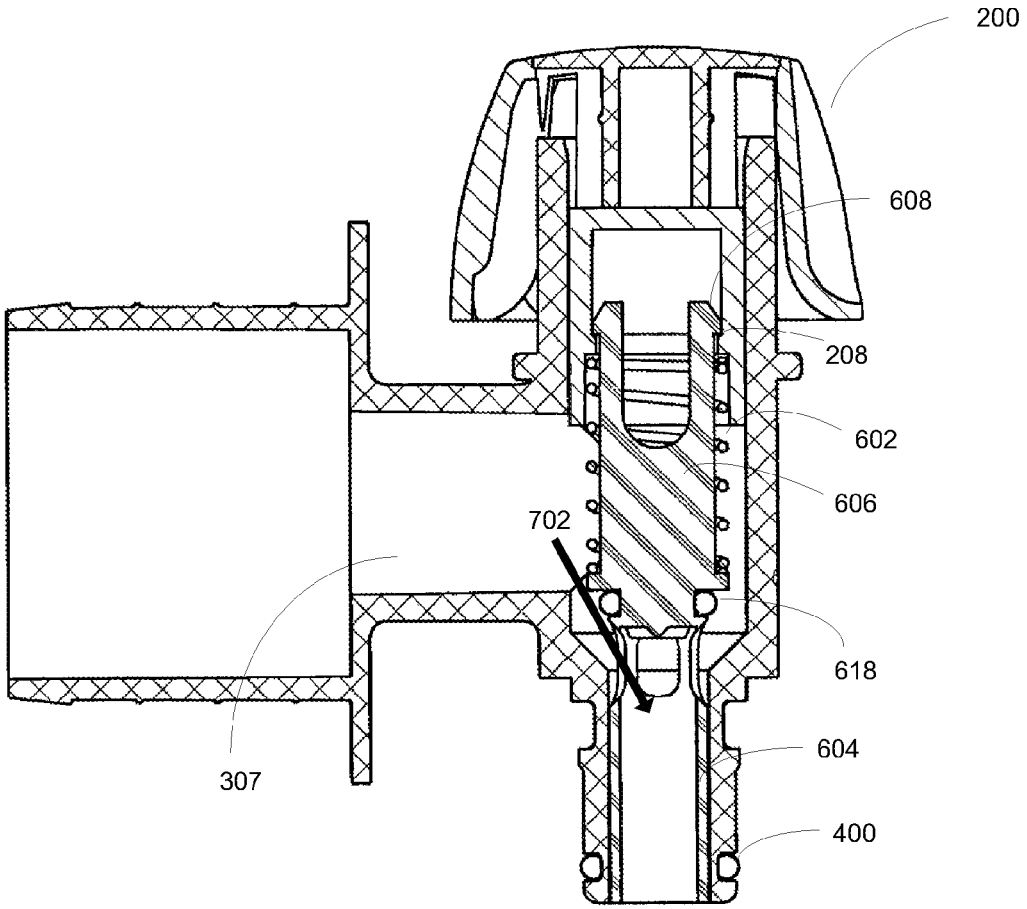
FIG. 12 is a left side sectional view of the embodiment shown in FIG. 9.

FIG. 12 is a right sectional view of the embodiment shown in FIG. 9, with the valve in an open position. Spring 602 winds helically about valve stem 606 between cylindrical base 616 and the lower surface of ridge 208, previously described as an internal ridge running circumferentially about an interior cavity in valve cap 200. FIG. 12 also shows an elastomeric sealing means 618, which may be an O-ring or any other suitable sealing means, seated within groove 614. Wine or other liquid situated in transition region 307 can now flow through the tap following liquid path 702.

Figure 13:
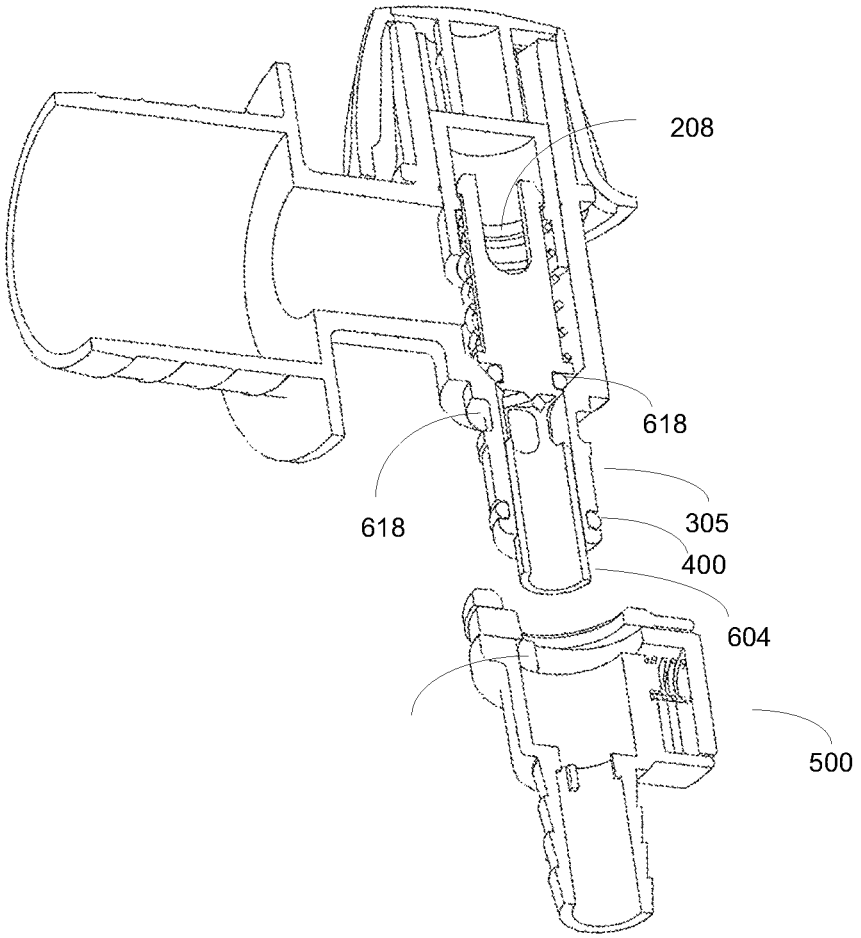
FIG. 13 is a perspective sectional view showing an embodiment having a biasing spring with the tap in the closed position and ready to receive a dispensing adapter.

FIG. 13 is a sectional perspective view showing the tap of FIG. 9 in a closed position and ready to receive automatic dispensing adapter 500. Sealing means 618 is resting against the lower portion of the internal passage through the tap and prevents liquid from flowing through the tap. Valve cap 200 is in a lowered, closed, position, and spring 602 is pressing against internal ridge 208 and cylindrical base 616, forcing valve 200 to a lowered position.

Figure 14:
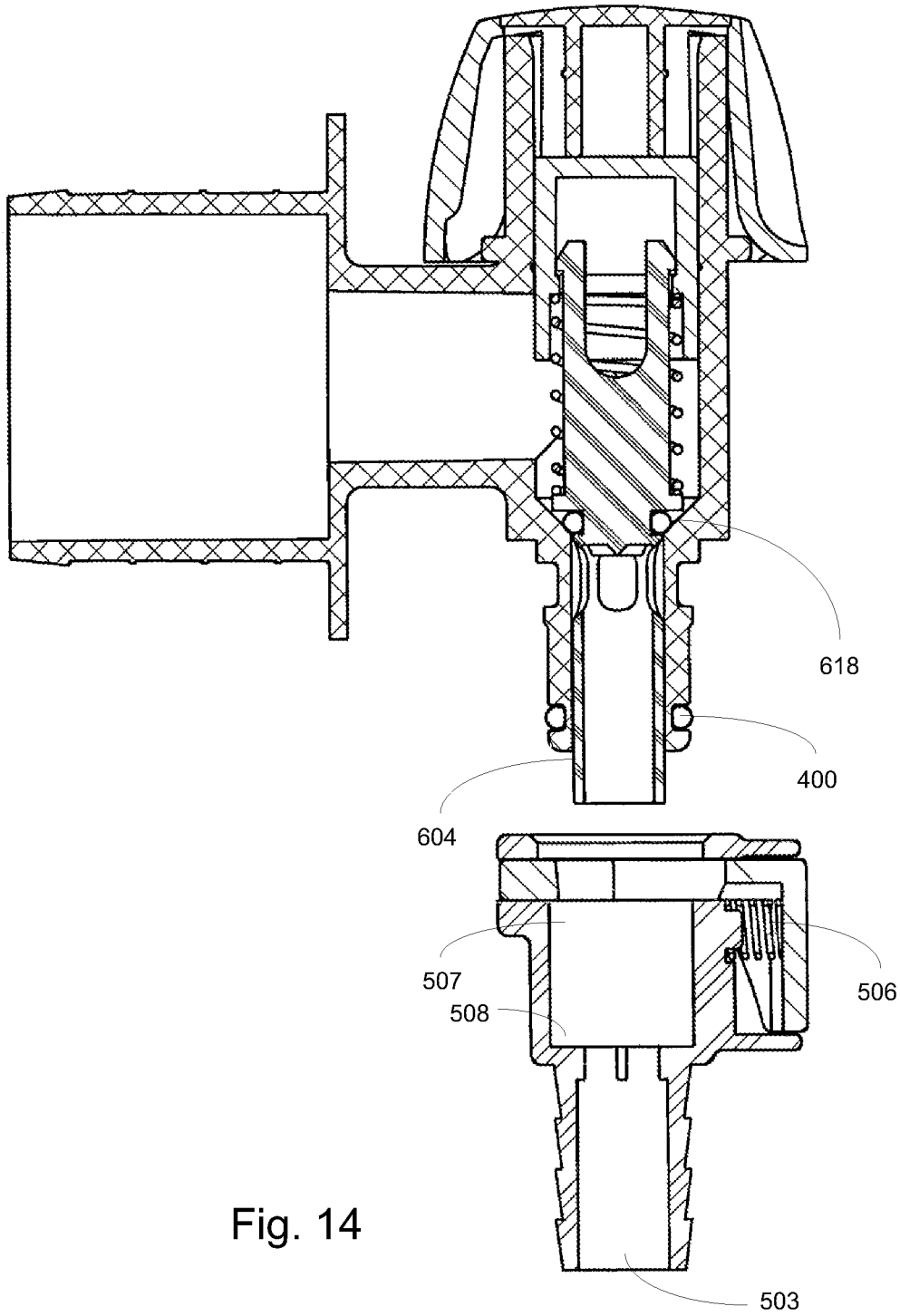
FIG. 14 is a left side sectional view of the embodiment shown in FIG. 11.
Figure 15:
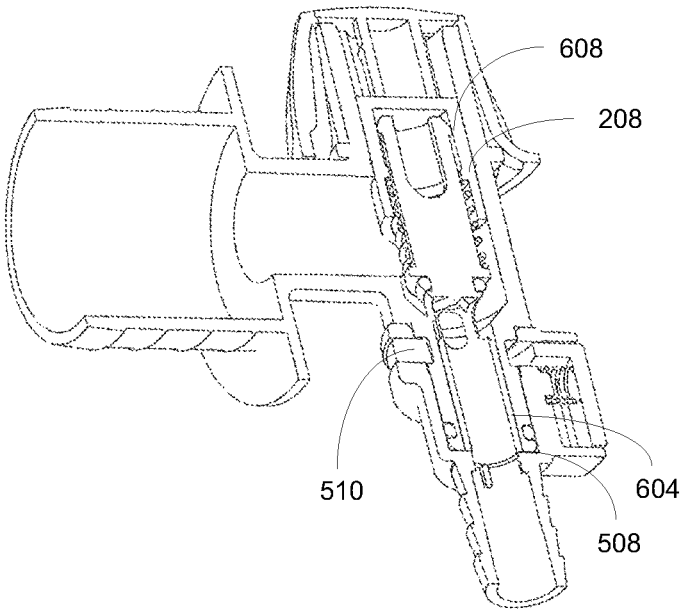
FIG. 15 is a perspective sectional view showing an embodiment having a biasing spring with the tap in the open position and the automatic dispensing adapter being attached.

FIG. 14 is a right sectional view of the configuration shown in FIG. 13, and shows tap 300 in a manually closed position and ready to receive automatic dispensing adapter 500. Sealing means 400, located at the outer surface of dispensing outlet 305 will be received in connecting socket 507 of automatic dispensing adapter 500. Connecting socket 507 has a shoulder 508 adapted to receive the lower end of valve 604 such that, when automatic dispensing adapter 500 is snugly attached to dispensing outlet 305, valve 604 will be pushed upward to the open position, and fluid passageway 702 will open, regardless of the position of valve cap 200. This configuration is depicted in FIG. 15, in which the lower end of valve 604 is resting upon shoulder 508, which has caused valve 604 to move upward, compressing compression spring 602.

Figure 16:
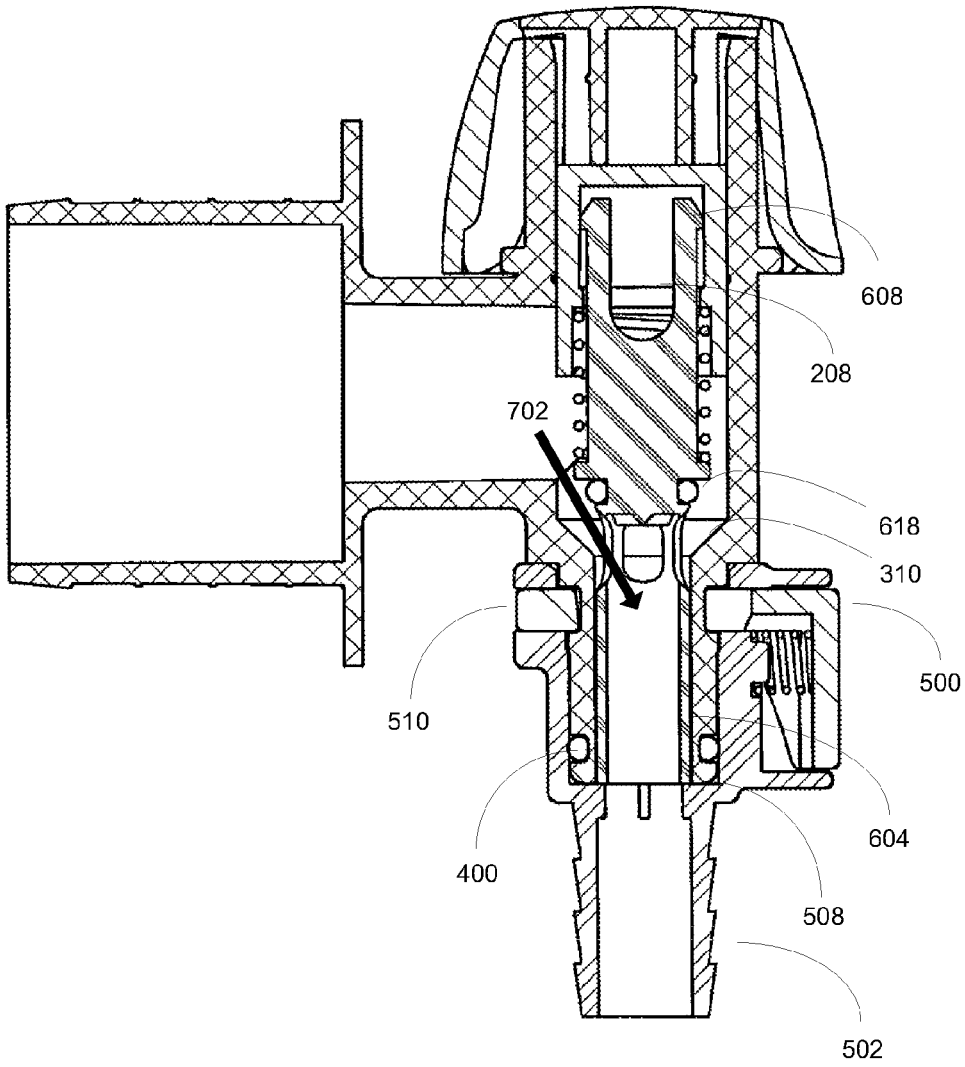
FIG. 16 is a left side sectional view of the embodiment shown in FIG. 13.

FIG. 16 shows tap 300 connected to automatic dispensing adapter 500 to create fluid passageway 702. The upward movement of valve 604 has also raised valve stem 606 and barbs 608 have moved to a position above internal ridge 208. In this configuration, the flow of wine or other fluid will be controlled by an external pump or other mechanism attached to the distal end of a tube (not shown) whose proximal end will be attached to hose barb 502.

It will be appreciated that the embodiment of tap 300 depicted in FIGS. 9-16 will always be forced open when automatic dispensing adapter 500 is attached, regardless of the manually selected position of valve cap 200. When automatic dispensing adapter 500 is released through quick fitting mechanism 504, 506, wine or other liquid may continue to flow unless valve cap 200 has been manually set to the closed position.

The tap of this invention may be used with automatic filling machinery to fill bladders with liquid such that minimal or no leakage occurs, and the filled bladders may be packaged for transportation and shipment. The embodiment of FIGS. 9-16 is particularly well suited for automated filling since the fluid path 702 is opened merely by pressing valve 604 into the tap, and fluid may then be injected into the bladder. Once filling is complete, the filling machinery may remove oxygen or ambient air, and may inject nitrogen or some other suitable gas into the bladder to equalize air pressure and prevent or reduce the introduction of oxygen into the bladder through permeation of the bladder surface. As no manual manipulation of valve cap 200 is required for such a filling procedure, the process may be automated, and the efficiency of the process will be enhanced.

The tap of this invention permits wine or other liquid to be dispensed manually or through the use of an automated dispensing apparatus. Regardless of the method used, oxygen does not come into contact with liquid that remains in the bladder, which may be preserved indefinitely without deterioration.

Persons of skill in the art will recognize that there are many implementation details and options left to the practitioner, but that would be within the scope of the current invention. It is intended that the foregoing detailed description be regarded as illustrative rather than limiting, and that it be understood that it is the following claims, including all equivalents, that are intended to define the spirit and scope of this invention.

We claim:

1. A tap for liquids comprising:

A tap body, a cap, a valve, a spring, and a dispensing adapter, said tap body further comprising an inlet having at least one sealing rib forming a liquid-tight seal with a bladder, a dispensing outlet having a receiving connector for receivably engaging a dispensing adapter, and a transition area for holding fluids between said inlet and said dispensing outlet, said dispensing outlet further comprising sealing means between said dispensing outlet and said dispensing adapter, said cap having an internal ridge running circumferentially around an internal cavity, said cap being rotatable to an open position when said cap is raised and being rotatable to a closed position when said cap is lowered, said valve further comprising a lower portion and an upper portion, said upper portion comprising a valve stem having two or more resilient fingers, each of said resilient fingers having an outwardly facing barb, each said barb being seatable upon an upper lip of said internal ridge and being able to be raised and lowered as said cap is raised and lowered, said lower portion comprising a cylindrical base, sealing means, and a hollow cylindrical extension, said hollow cylindrical extension having openings therethrough and extending below the lowest portion of said dispensing outlet, said sealing means contacting and closing a liquid passageway between said sealing means and an inner surface of said tap when said valve is lowered, a compression spring helically coiled around said valve stem and extending between said cylindrical base and the lower lip of said internal ridge, said dispensing adapter comprising a socket having an inner shoulder whereby, when said dispensing adapter is attached to said dispensing outlet, said inner shoulder forces the lower end of said valve upwardly to open said liquid passageway.

2. A tap for releasing a liquid held in a reservoir, the tap comprising:

a tap body including an inner bore having opposed first and second ends, the first end defined below the second end such that a fluid in the inner bore would pass through the first end by gravitational force, an inlet projecting from between the first and second ends of the inner bore, the inlet fluid-tightly connectable with the reservoir, the inlet having a transition area thereby permitting fluid communication between the reservoir when connected and the inner bore through the inlet, and a dispensing outlet projecting from the first end of the inner bore; a valve cap having a bore portion and a knob, the bore portion receivable within the inner bore of the tap body proximate the second end of the tap body, the valve cap engagable with the inner bore into order to raise the bore portion of the valve cap between an open and closed position, the bore portion including an internal ridge; and a press valve insertable into the inner bore and including an upper portion having a barb with at least two resilient fingers engagable with the internal ridge of the bore portion of the valve cap in order to raise or lower the barb as the valve cap is raised or lowered, and a lower portion dimensioned such that at least part of the lower portion projects beyond the dispensing outlet when the press valve is inserted, the lower portion substantially hollow and including at least one opening positioned such that when the press valve is raised to the open position the at least one opening is placed in fluid communication with the inner bore and when the press valve is lowered to the closed position the at least one opening is blocked from fluid communication with the inner bore.

3. The tap of claim 2, further comprising a dispensing adapter fittable over the dispensing outlet, the adapter including a shoulder abutted against the lower portion of the press valve when the adapter is fitted over the dispensing outlet thereby raising the press valve to the open position when the adapted is fitted over the dispensing outlet.

4. The tap of claim 3, the press valve further including a cylindrical base provided between the upper and lower portions, and a compression spring provided around the upper portion and resting on the cylindrical base, whereby the compressing spring presses against the internal ridge of the bore portion when the press valve is inserted into the inner bore.

5. The tap of claim 4, the press valve further comprising a sealing means resting around the lower portion of the press valve against the cylindrical base.

6. The tap of claim 2, the tap body further including at least one sealing rib for forming a liquid-tight seal with the reservoir.

7. The tap of claim 2, the at least one opening of the press valve is a plurality of windows.

8. The tap of claim 2, wherein the inner bore and the bore portion of the valve cap are substantially coaxial when the bore portion is received.

9. The tap of claim 8, wherein the inlet projects substantially perpendicular to the inner bore.

10. The tap of claim 2, wherein the valve cap is threadably engaged with the inner bore, rotation of the knob in a first direction thereby raising the valve cap to the open position and rotation of the knob in a second direction thereby lowering the valve cap to the closed position.

11. The tap of claim 10, wherein an inner side of the knob is threadably engaged with the inner bore.

12. The tap of claim 3, wherein the reservoir is a compressible bladder.

13. The tap of claim 12, wherein the adapter is connectable to pump in order to fill the compressible bladder with a fluid when the adapter is fitted over the dispensing outlet.

14. The tap of claim 2, wherein the press valve is insertable into the inner bore through the first end of the inner bore.

* * * * *